US006248021B1

(12) United States Patent
Ognjanovic

(10) Patent No.: US 6,248,021 B1
(45) Date of Patent: Jun. 19, 2001

(54) VISUAL IMPACT DETECTION GOLF TEACHING SYSTEM

(76) Inventor: Zivota Ognjanovic, 35920 42nd St. E., Palmdale, CA (US) 93552

( * ) Notice: Subject to any disclaimer, the term of this patent is extended or adjusted under 35 U.S.C. 154(b) by 0 days.

(21) Appl. No.: 09/338,852

(22) Filed: Jun. 25, 1999

(51) Int. Cl.[7] ..... A63B 57/00
(52) U.S. Cl. ..... 473/131; 473/252
(58) Field of Search ..... 473/218, 131, 473/140, 151, 192, 154, 195, 199, 252, 285, 329–330, 342, 337

(56) References Cited

U.S. PATENT DOCUMENTS 4,974,851 * 12/1990 Closser et al. ..... 273/186 D
5,121,924 * 6/1992 Reed ..... 273/186 E
5,209,483 5/1993 Gedney .
5,230,512 7/1993 Tattershall .
5,709,610 1/1998 Ognjanovic .
5,792,001 8/1998 Henwood .

* cited by examiner

*Primary Examiner*—Valencia Martin-Wallace
*Assistant Examiner*—Kim T. Nguyen
(74) *Attorney, Agent, or Firm*—Barbara R. Greenberg

(57) ABSTRACT

Teaching golf clubs that signal a golf ball/club face impact location comprising a putter having a head with an elastomer or thin hard material face cover protecting piezoelectric sensors electrically connected to an electrical circuit provided with light emitting diodes (LEDs) arranged to visually indicate the impact location, the electrical circuit printed on a circuit board tightly inserted into a golf club head cavity or embedded in a plastic matrix and an iron and a "wood" golf clubs having elastomer or thin hard materials coated on plates inserted into piezoelectric sensors electrically connected to an electrical circuit on a circuit board inserted into a club head cavity or embedded in a plastic matrix with LEDs indicating a golf ball/club face impact location. Each teaching club has a matching Profession Golf Association approved club for golf course play.

16 Claims, 6 Drawing Sheets

VISUAL IMPACT DETECTION GOLF TEACHING SYSTEM

BACKGROUND OF THE INVENTION

1. Field of the Invention

The present invention relates to teaching golf clubs and matching Professional Golf Association (PGA) approved golf clubs, more specifically teaching and matching professional putters, irons and "woods", so that the teaching clubs provide user information concerning a point of club face impact on a golf ball thereby helping the user to develop a smooth, consistent golf swing and the professional clubs provide a means for putting the information learned in actual golf course play. The teaching golf clubs utilize club head self contained visual display means for imparting club/ball impact information. The user trains using the teaching golf clubs and transfers to the professional clubs for golf course play. It should be noted that a "wood" is no longer constructed of wood but can be made of metal alloys, high impact plastics or any number of synthetic materials.

2. Discussion of the Prior Art

In order to maintain or improve a golf game, a golfer must develop an efficient golf swing where the golf ball is impacted on the club center or "sweet spot". This impact transfers maximum energy from the club head to the ball and allows the ball to travel on a trajectory intended by the user. Whether or not the ball impacts on the club center or "sweet spot" is not always obvious to the user. When the user has a means for knowing a point of impact, the user can quickly made constructive changes to improve his/her golf swing. After a golfer consistently makes ball contact with the golf club face "sweet spot" as indicated by a visual signal, the golfer gains confidence and attains "muscle memory" that eventually allows the golfer to automatically swing correctly. Then the golfer is ready to use a PGA approved golf club without ball impact information but having substantially identical weight, balance, shape and size as the teaching club on a regulation golf course.

The following relevant golf club training devices are the result of a customary prior art search: U.S. Pat. No. 4,898,389 discloses a training golf club comprising a clip on carrier unit have a transducer array overlying a golf club face and a monitor display sitting on a golf club top surface. A ball impact generates a voltage proportional to a force exerted on a transducer which is analyzed to indicate the point of impact. In the present invention, an analysis of voltage generated by an impact on a club face sensor is not dependent on the amount of impact force. In addition, all detection components are internal where component vibration and movements on ball impact are almost non existent. In a clip on arrangement, vibration and movement on ball impact are likely to effect the accuracy and precision of transmitted monitor information.

U.S. Pat. No. 4,940,236 describes a golf club built in swing analyzing device that utilizes a club face transducer to produce signals sent to a club grip cap LCD indicator to inform the user of the total yardage traveled by an impacted ball. Since output information differs from the present invention output, impact analyzing electrical circuitry is also different.

In U.S. Pat. No. 5,209,583 a user notification device informs the user of a trajectory followed by a movable object such as a golf ball after an instrumented sporting device such as a golf club strikes the golf ball. Here, again, output information and electrical circuitry differ from the present invention.

In U.S. Pat. No. 5,709,610 the present inventor discloses a spring controlled push button electrical contact system used to transmit information concerning golf ball impact on a golf club face by means of LED signals. The present invention provides a different impact sensor means along with new circuitry for detecting golf ball impact location on a club face.

In addition, U.S. Pat. Nos. 3,182,508, 5,230,512 and 5,441,269 along with U.S. Pat. No. 5,792,001 disclose golf club training devices that notify the user of the magnitude of force of a golf ball impact, of a path of a club swing and of any abnormal acceleration of deceleration of a putter club head, respectively.

None of the relevant prior art inventions disclose a combination of pressure sensors embedded in a golf club face that stimulate LED indicators to disclose golf ball/club face impact location for use in a teaching setting along with a matching professional golf club for use in a playing setting on a regulation golf course.

The primary objective of the present invention is to provide a teaching golf club having self contained golf ball impact sensor means in order to instantly indicate visually to the user ball impact location and, then, to provide the user with an identically balanced and designed PGA approved golf club for golf course play and/or tournament competition.

Another objective is to provide golf club self contained impact sensory means of miniature size that are able to withstand repeated golf ball impact vibrations and jarring.

A further objective of the invention is to furnish a teaching golf club with instant feedback so that the user can make immediate adjustments and develop a correct golf swing that becomes part of the user's muscle memory.

In addition, a further objective of the invention is to provide a simple golf stroke teaching club to be used for a quick, self taught lesson before golf course play.

There is a need for putter, iron and "wood" teaching golf clubs that can be used for practice and matching golf clubs that can be used for golf course play. A player who practices with teaching golf clubs and then plays on a golf course with substantially identically shaped, weighted and balanced PGA approved golf clubs can repeat successful practice golf swings in actual play thereby gaining confidence with each swing.

SUMMARY OF THE INVENTION

In accordance with the present invention, a thin hard material or an elastomer cover at least one sensor element embedded on a front surface of a putter face so that a golf ball impact on the elastomer or on the thin hard material covering the putter face distorts the sensor element initiating an electrical signal received by an electrical processing circuit imprinted on a circuit board having at least one LEDs available to signal golf ball impact location. The sensor elements are affixed to an elastomer having a grid patterned surface and the sensor grid assembly can be backed by a resilient, foam like material which minimizes vibrations and intensifies the electrical signal. The electrical processing circuit detects the ball impact location using a colored LED display to inform the user of the location, the LEDs emitting one color for "sweet spot" impacts and other colors for off center impacts. The LED display output is observed by the user through apertures located on the putter top surface. Each sensor zone stimulates its own associated circuit and LED output. A golf ball simultaneously striking more than one sensor element results in the simultaneous light up of more than one LED signal showing more than one zone of impact. Switch means are provided within a club grip cap so a user can depress a reset switch to turn off an LED output signal that resulted when the putter impacted a golf ball. Then the teaching putter is ready to register another ball impact. An on/off switch in the club grip cap controls a power supply comprising a plurality of batteries in a putter shaft distal end interior. The batteries rest on a spring provided to absorb vibrations and jarring from a club head/golf ball impact.

For irons and "woods", where a force generated by a golf ball impact on a club face far exceeds a force of impact on a putter, the club faces have a durable, vibration resistant golf ball impact detection system comprising at least one elastomer or thin hard material covered plate, the plate disposed to cover impact detecting sensors embedded into the club faces. For the irons and "woods", at least one elastomer pad or the thin hard material adheres to a front surface of at least one plate and a centrally located U-shaped flexible projection extends perpendicular to the plate back surface. At least one sensor element embedded on the iron and "wood" club head faces defines a centrally located stepped down aperture that receives the U-shaped flexible projection so that the plate is snapped against an opposing sensor and more than one plate abuts an adjacent plate. As a result, elastomer pads or thin hard material on the plates' front surfaces form a smooth, planar club face exterior. The impact detecting sensor elements respond to a golf ball/golf club impact force on the elastomer or thin hard material surface of a plate by sending electrical signals through a printed circuit that results in LED output that shows a golf ball point of impact on the club face. A reset switch in an iron or "wood" grip cap provides means for LED on off switching. A power supply inserted in an iron and "wood" shaft distal end interior is made available to the user through a grip cap inserted on off switch.

In a preferred embodiment, the putter, iron and "wood" club face sensor elements are composed of piezoelectric film with an electrode pattern having a plurality of electrodes printed with silver conductive ink on a front side of the film and a common electrode printed with silver conductive ink on a back side, the back side conductor connected to the front side via a silver plated aperture in the film. To protect the sensor elements, the piezoelectric film retains an outer coat of a plastic material such as mylar. Between the layers of silver conductive ink comprising front and back electrodes, a uniform layer of polyvinylidene fluoride (PVDF) provides voltage output upon distortion from a golf ball impact.

For putter, iron and "wood" clubs, the thickness of the elastomer or thin hard material is used to help control the activation of the sensor elements when a golf ball impact occurs. A putter head face has a thin elastomer or hard material cover compared to the elastomer pads or hard material faced on iron and "wood" club head faces. In addition, a light weight putter will have a thicker face cover compared to a heavier putter since the light weight putter requires more striking force to move a golf ball the same distance as with the heavier putter. Along with elastomer thickness, electrical circuitry adjusts a signal generated by the golf ball impact force to achieve a proper LED output message.

In another embodiment, an elastomer or thin hard materials cover for the putter and elastomer pads or thin hard cover on the plates for the irons and "woods" are coated on to piezoelectric film sensor elements which are affixed to a metal alloy backing and metal alloy plates, respectively, the metal alloy backing and plates having microscopic holes filled with a plastic type material such as silicone to ease sensor element distortion and enhance a ball impact force and corresponding electric signal.

The LED output display can be arranged in a plurality of numbers, patterns and light colors. In preferred embodiments, putter and "wood" club head top surfaces can display LEDs in a single horizontal row of six LEDs, the middle two being green, the end two being red and the remaining two being yellow when a single horizontal row of six corresponding sensor elements are activated by a club/ball impact. Putters and "woods" can also have LED indicators in two horizontal rows of three each where middle front and back LEDs emit green light when corresponding middle top and bottom sensor elements are stimulated, end front and back LEDs emit red light when corresponding end top and bottom end sensor elements are impacted while remaining front and back LEDs emit yellow light when remaining sensor elements are impacted.

A preferred embodiment for irons consists of four LEDs in a single horizontal row, the middle two LEDs emitting green lights and the end two LEDs emitting red lights responding to electrical signals generated by golf ball impacts on four iron club face sensor elements aligned in a signal horizontal row to correspond to electrically related LEDs.

In a preferred embodiment, putter, iron and "wood" sensor elements are arranged to be a distance apart no greater than the diameter of a professionally approved golf ball dimple diameter so that a golf ball impacting exactly between two adjacent sensors can send electronic signals simultaneously to two corresponding LEDs, both exhibiting lights giving a user accurate ball impact location information.

Each teaching golf club can have a matching PGA approved professional golf club for recreational and tournament golf course play. When a user makes successful, repetitive golf swings with the teaching clubs, the user develops muscle memory where successful swings are automatic. These swings developed through teaching club use can carry over to golf course play when the user employees PGA approved matching clubs having substantially the same weight, balance, size, shape and overall appearance and constructed of the same materials as the teaching clubs.

In accordance with another aspect of the invention, a paired set of golf clubs includes a teaching golf club having predertermined mechanical properties including weight distribution, flexibility and club face resilience, and a PGA-approved matching golf club having substantially the same predetermined properties, wherein said teaching golf club includes at least one sensor on the face of the teaching club for energization when the club impacts a golf ball, and a corresponding two-dimensional display visible on said teaching club displaying the location of the impact of the club on the golf ball, so that a golfer's swing may be improved by improving the impact location of the ball and club face through the use of the teaching club, and the golfer may subsequently carry over this teaching to the use of the correspondingly paired PGA approved golf club. It is further noted that at least one sensor may include at least two parallel horizontally spaced rows of sensors, with at least three sensors in each row.

Additional features as well as other advantages and a fuller understanding of the nature and objectives of the present invention will become apparent from the following detailed description of the preferred embodiment along with the accompanying drawings and claims.

DETAILED DESCRIPTION OF PREFERRED EMBODIMENTS

Figure 1B:
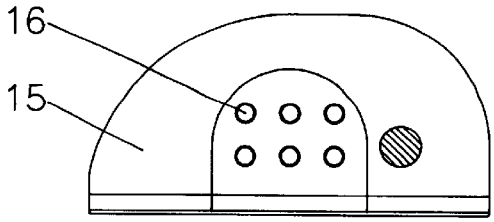
FIG. 1B is a top surface plan view of a teaching putter head showing apertures for LED light emission.
Figure 1A:
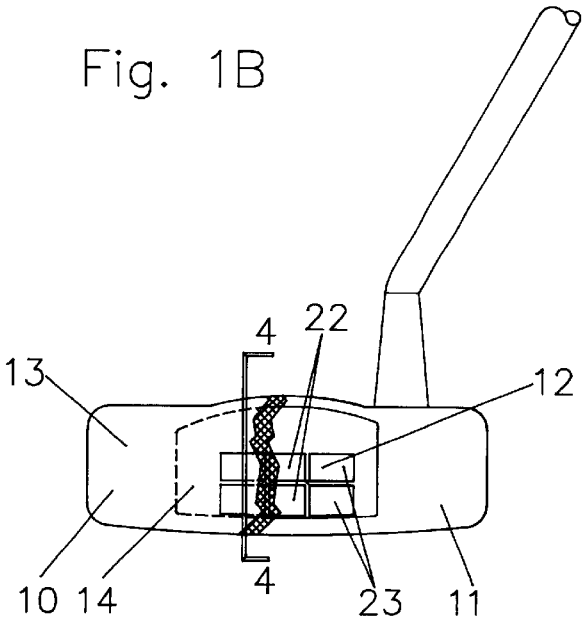
FIG. 1A is a front plan view of a teaching putter face partially broken to show sensor elements.
Figure 1C:
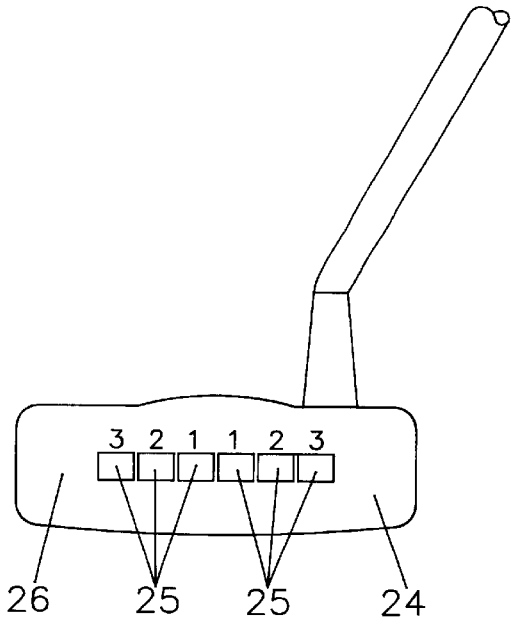
FIG. 1C is a front plan view of a teaching putter face showing an alternative embodiment for sensor element placement.
Figure 2:
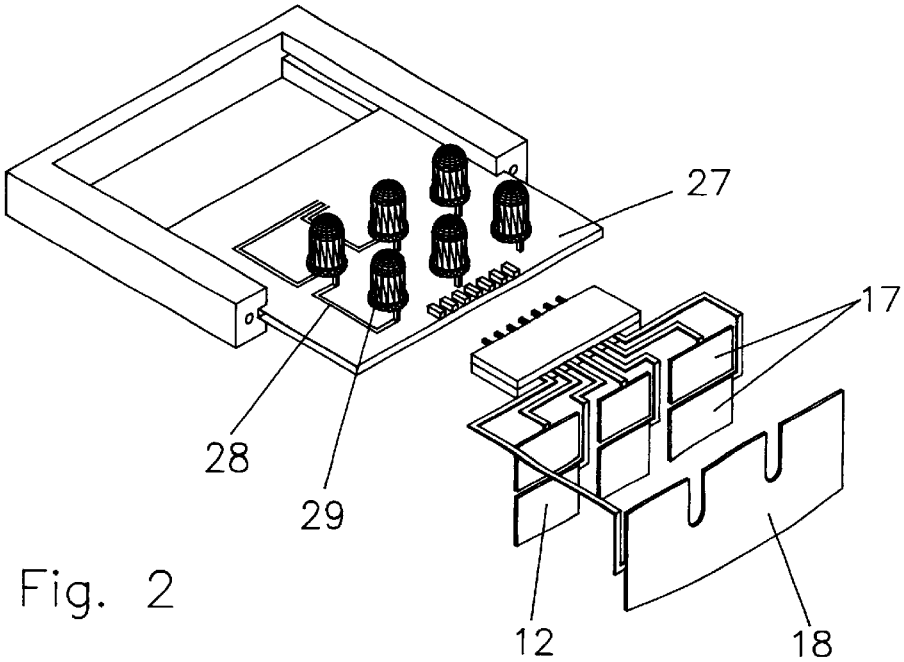
FIG. 2 is a perspective diagram of a sensor element grid assembly electrically connected to a circuit board having a printed circuit with LED output capacity.

Referring to the drawings, and particularly FIGS. 1A, 1B and 1C, preferred embodiments of the present invention teaching putter 10 are illustrated comprising a putter club head 11 having at least one sensor element 12 such as a piezoelectric film sensor, embedded in the teaching putter's face 13 that generates an electrical visual signal when distorted by a golf ball impact, an elastomer cover or thin hard material 14, having a smooth outer surface and a grooved inner surface, affixed to the club face 13 by screw means or by adhesive to protect the sensor elements 12 from golf ball impact damage and having a club head 11 top surface 15 defining at least one of aperture 16 through which output information indicating golf ball impact locations is visible. The elastomer cover or thin hard material cover 14 can be made of a rubber like material, polyvinylchloride plastic, an aluminum titanium alloy or any other resilient or metallic material. The elastomer or thin hard material cover 14 has inner surface grooves that are a minimum of 0.01 inch in width and a minimum of 0.02 inch in depth. The elastomer cover or thin hard material 14 is a minimum of 0.03 inch thick. The grooves define square or rectangular pads large enough to cover an underlying sensor element 12. In addition to piezoelectric film, several types of impact sensitive materials including piezoresistive films and capacitive materials can be used as sensor elements 12. The piezoelectric film can be laminated in the following order: 0.0005 inch mylar, a front silver ink electrode 17, 28 $\mu$M PVDF film, a back silver ink electrode 18 and a clear-cut layer, the mylar layer facing to the front of the putter 10 face 13. FIG. 2 illustrates electrodes 17, 18.

Figure 4:
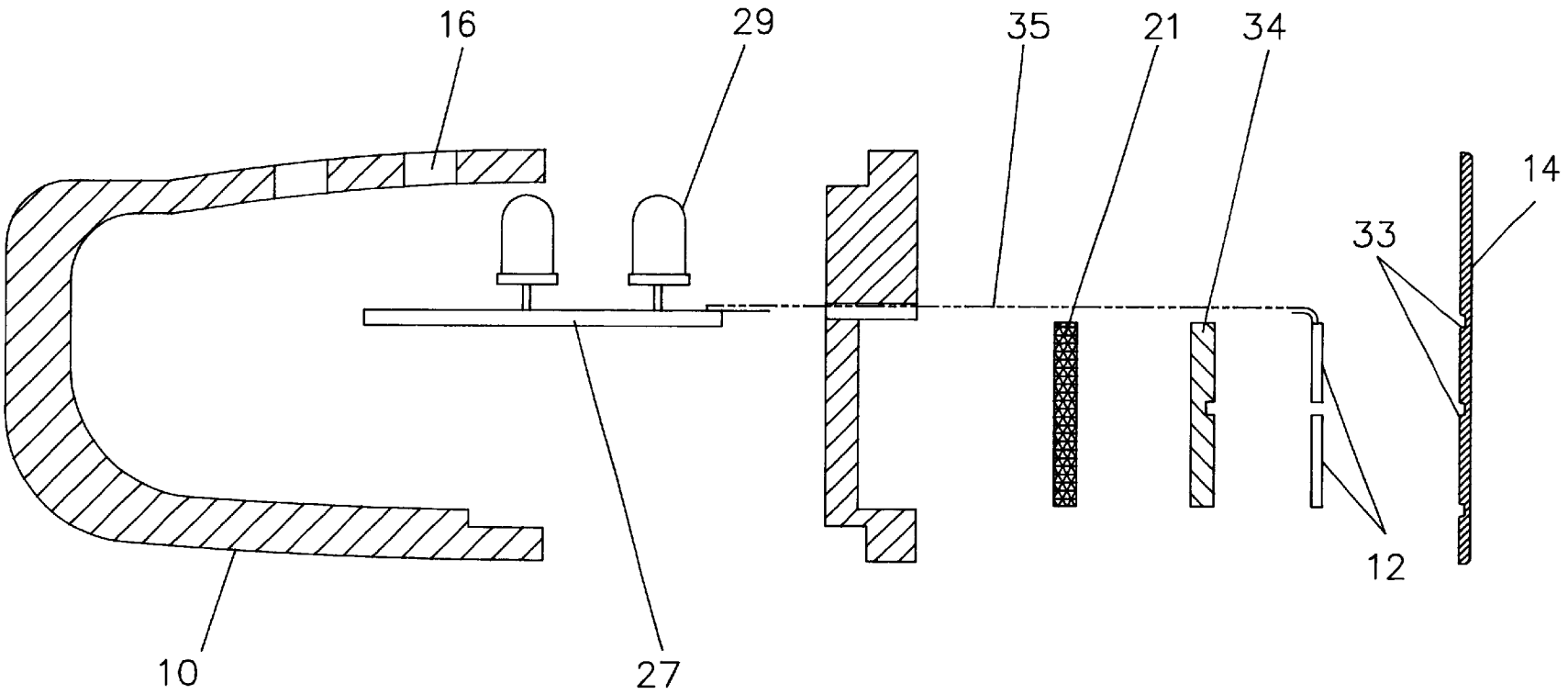
FIG. 4 is a sectional expanded view of a teaching putter club head taken along line 4—4 of FIG. 1A.

Also, the teaching putter 10 is comprised of a shaft 19 having a distal grip portion 20 as illustrated in FIG. 5. In addition, a foam layer 21, as seen in FIG. 4, backing sensor elements 12 allows a golf ball impact to slightly deflect a sensor element 12 thereby maximizing an electrical signal generated from the impact.

In a preferred embodiment, as seen in FIG. 1A, sensor elements 12 are arranged in two parallel horizontally spaced rows of three with top and bottom central sensors 22 directly over the club face 13 sweet spot. Adjacent sensor elements 12 are separated from each other by a distance no greater than 0.05 inch so that a golf ball having a dimple diameter of 0.05 inch can impact two sensor elements 12 simultaneously with resulting simultaneous visual output signals. In one embodiment, central sensors 22 have a 0.40 inch width and end sensors 23 have a 0.50 inch width. Top row sensor elements 12 have a 0.30 inch length and bottom row sensor elements 12 have a 0.35 inch length.

In another embodiment, in FIG. 1C, a teaching putter 24 having sensor elements 25 in a single horizontal row array of six sensor elements 25, each sensor element 25 separated from the other by a distance no greater than 0.05 inch. The six sensor element 25 array can be embedded in the teaching putter 24 face 26. All other aspects of teaching putter 24 are the same as in teaching putter 10 as described above. In FIGS. 1A and 1B, the sensor elements 12 and 25, respectively, are equal in thickness to indentations on putter faces 13 and 26, respectively, so flat, planar club faces result.

Figure 3:
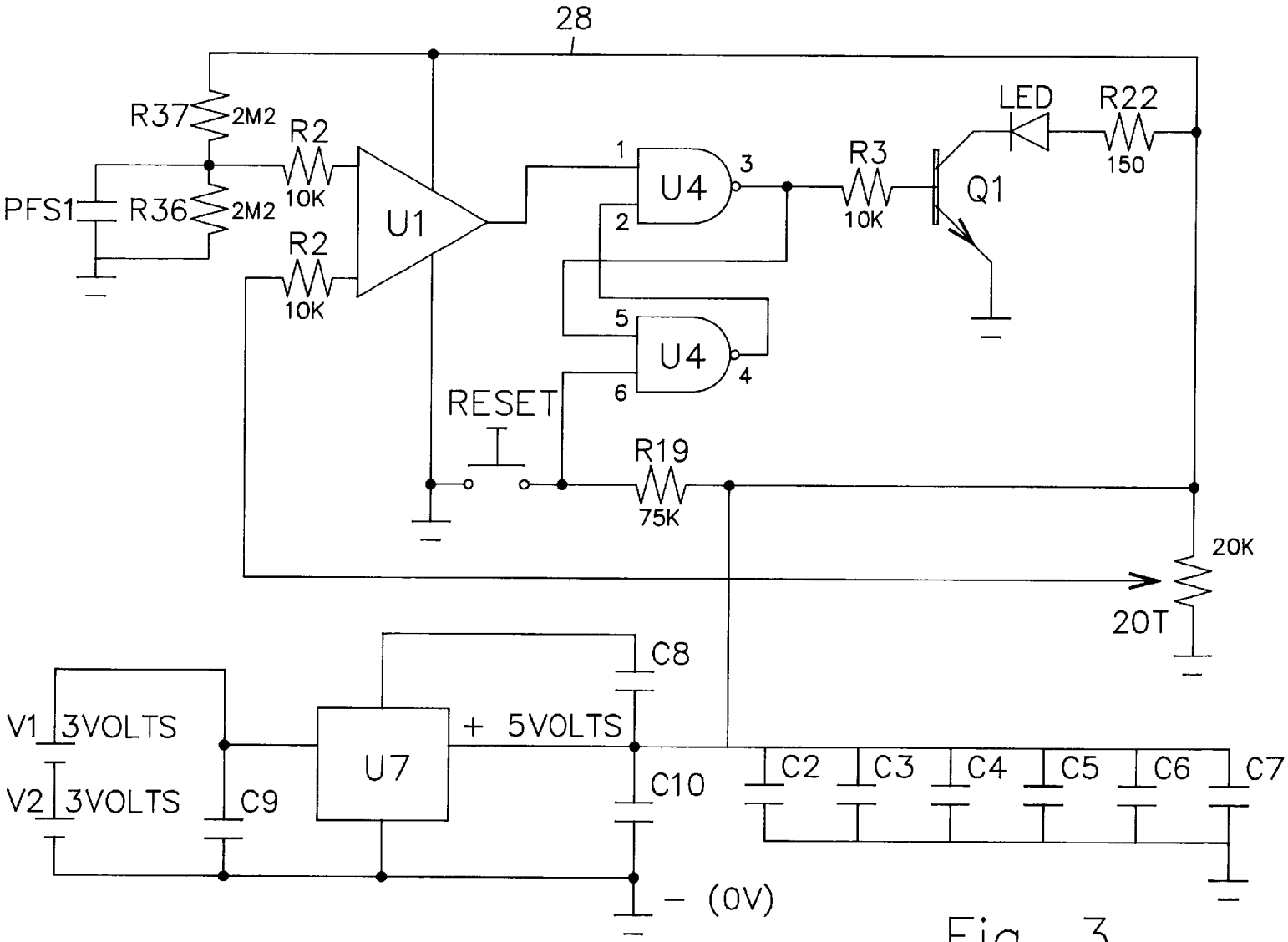
FIG. 3 is a schematic diagram of a single module of an electronic circuit for a teaching putter.

Turning now to FIG. 2, an array of sensor elements 12 are shown electrically connected to a printed circuit board 27 having a printed circuit 28 as illustrated in FIG. 3 with light emitting diode (LED) 29 visual output means. The LEDs 29 are positioned in order to be received by apertures 16, the LEDs 29 projecting upward within apertures 16 to a distance below club head 11 top surface 15. Printed circuit board 27 slips into a teaching putter 10 club head 11 cavity and is secured within the cavity walls by friction force or, if necessary, by screw means. In another embodiment, printed circuit board 27 is embedded in a molded plastic matrix forming part of a putter club head 11.

FIG. 3 shows a schematic diagram of a single module of printed circuit 28 illustrating a means for transmitting an electric signal generated from a golf ball impact on a sensor element 12 or a sensor element 25 to a visual LED 29 output indicating an impact location. Simultaneous golf ball impacts on more than one sensor element 12, 25 results in simultaneous visual LED outputs. The number of modules needed depends on the number of sensor elements 12 or sensor elements 25 in a teaching club. When more than one LED 29 output is desired, a plurality of modules are connected to the same power supply 30, having a common reset button 31, both seen in FIG. 5. Every module with LED output is the same regarding sensitivity adjustments.

Now turning to printed circuit 28, when on off switch 32 is turned on, power supply 30 comprising two 3 volt batteries supply power to voltage regulator U7 that, in turn, supplies circuit 28 with a transistor to transistor voltage of 4.5 to 5.0 volts. A signal from piezoelectric film sensor element 1, PFS1, representing one sensor element 12, is initially amplified through operational amplifier U1 which is connected in a differential mode open loop for high sensitivity. R1 and R2 limit two inputs of current, from PFS1 and from power supply 30, to U1. When PFS1 is undisturbed, the voltage on non inverting input is maintained at 2.5 volts. This is achieved with a voltage divider made of resistors R36 and R37 having a resistance of 2.2 Mohm each. Inverting input is also adjusted to a potential of about 2.5 volts. A small difference from the 2.5 voltage is adjusted in order to give the output of the operating amplifier U1 voltage high enough for chips U4 logical HI. This adjustment of inverting input potential is achieved through resistor 20T. Since the output of operating amplifier U1 is HI, pin No. 1 of a first NAND gate contained in chip U4 is HI as well. With a second NAND gate of U4, pin No. 1 forms a set/reset latch. A reset pin, pin No. 6 of the set/reset latch is HI. Therefore, the output of the latch is LOW. This condition keeps an LED 29 turned off since a driving transistor Q1 has no electrical potential on its base. When an impulse from PFS1 occurs, the operating amplifier U1 provides an output in a range of logical LOW that results in the output of the set/reset latch to turn HI. This HI output, limited by resister R3, turns on transistor Q1 and the LED 29 turns on as well. The circuit 28 stays latched in this HI position even though the PFS1 signal is no longer present. Finally when pin No. 6 is brought to a LOW position by a putter 10 user who presses the reset button 31, the latch is reset and the circuit 26 is ready to register another impulse from the PFS1. When the circuit 28, as shown in FIG. 3 is in a highly sensitive mode, the club face 13 elastomer or thin hard cover 14 can be thick and the club head 11 weight can be low. Circuit 28 sensitivity can be lower when the elastomer or thin hard cover 14 is thin and the club head 11 is heavy. Ideally, the elastomer or thin hard cover 14 ranges in thickness from 0.375 inch to 0.03125 inch.

Returning to FIG. 1A, electrical impulses from central sensor elements 22 can turn on middle LEDs 29 that can be green in color, a lower sensor 22 corresponding to a middle front LED 29 and an upper sensor 22 corresponding to a middle back LED 29. When end sensors 23 impact a golf ball, end LEDs 29 and lower sensor 23 can correspond to end back LED 29. Other LED 29 color combinations can be substituted to provide an immediate and easily understood signal indicating golf ball/golf club point of impact. The ability to increase or decrease the number and arrangement of sensor elements 12 and corresponding LEDs 29 is only limited by a club head size. A teaching putter 10 club head 11 face 13 can have one sensor element 12 placed on a sweet spot and one corresponding LED 29.

In FIG. 4, a section taken along line 4—4 of FIG. 1A of the teaching putter 10 shows the elastomer or thin hard material cover 14 with back surface grooves 33 the sensor elements 12 affixed to a resilient elastomer padding 34, a foam backing 21, electrical connections 35, between sensors 12 and circuit board 27, LEDs 29 and apertures 16.

Referring again to FIG. 1C, the single row of sensor elements 25, upon golf ball/golf club impact, can send impulses through circuit 28 to activate LED 29 point of impact information. Center sensor elements, numbered one for identity, can activate green LEDs 29, sensor elements numbered two for identify can activate yellow LEDs 29 and sensor elements numbered three for identity can activate red LEDs 29 using FIG. 3 circuitry. LEDs 29 are observed through the putter 10 top surface 15 apertures 16, the apertures 16 arranged in a single horizontal row.

Figure 5A:
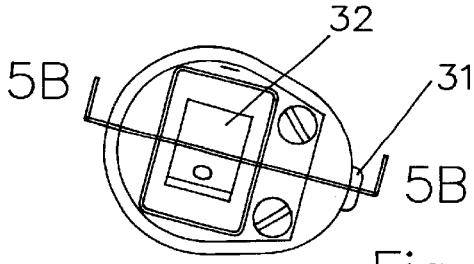
FIG. 5A is a top view of a teaching putter, iron or "wood" golf club shaft distal end showing switching means.
Figure 5B:
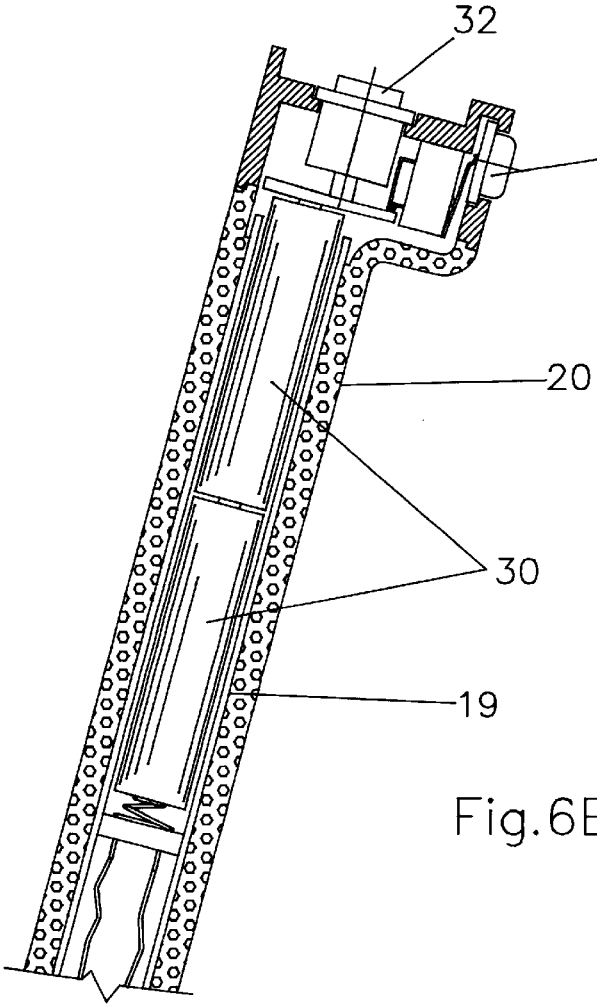
FIG. 5B is a sectional view of a teaching putter, iron or "wood" golf club shaft distal end taken along line 5B—5B of FIG. 5A.

FIG. 5A is a top view of a teaching putter, iron or "wood" golf club shaft distal end showing switching means including on off switch 32 and reset button 31. FIG. 5B is a sectional view of a teaching putter, iron or "wood" golf club shaft distal end taken along line 5B—5B of FIG. 5A showing power supply 30. On off switch 32 makes available the power supply 30 for the printed circuit 28 as illustrated in FIG. 3. With the on off switch 32 on, an electrical impulse from a sensor elements 12 or 25 results in an LED 29 emitting light which remains on until a user presses the reset button 31. Then the LED 29 is ready to again emit light when a golf ball deflects sensor elements 12 or 25.

Figure 6B:
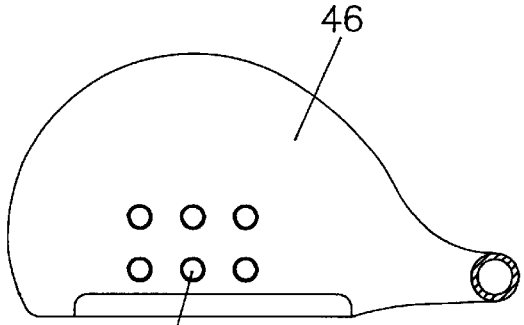
FIG. 6B is a top plan view of a teaching iron and "wood" club head.
Figure 6A:
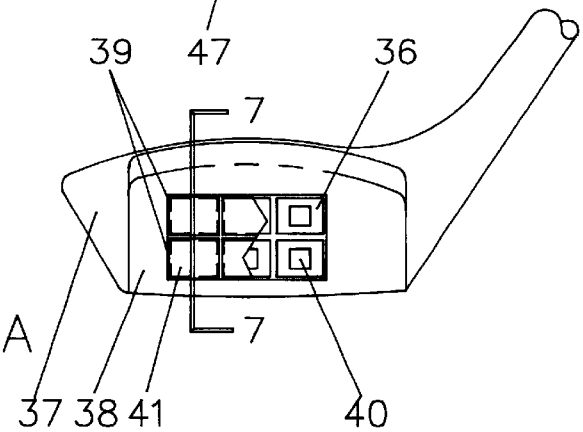
FIG. 6A is a front plan view of a teaching iron and teaching "wood" club head showing uncovered sensor elements and elastomer or hard material coated plates covering sensor elements.
Figure 7:
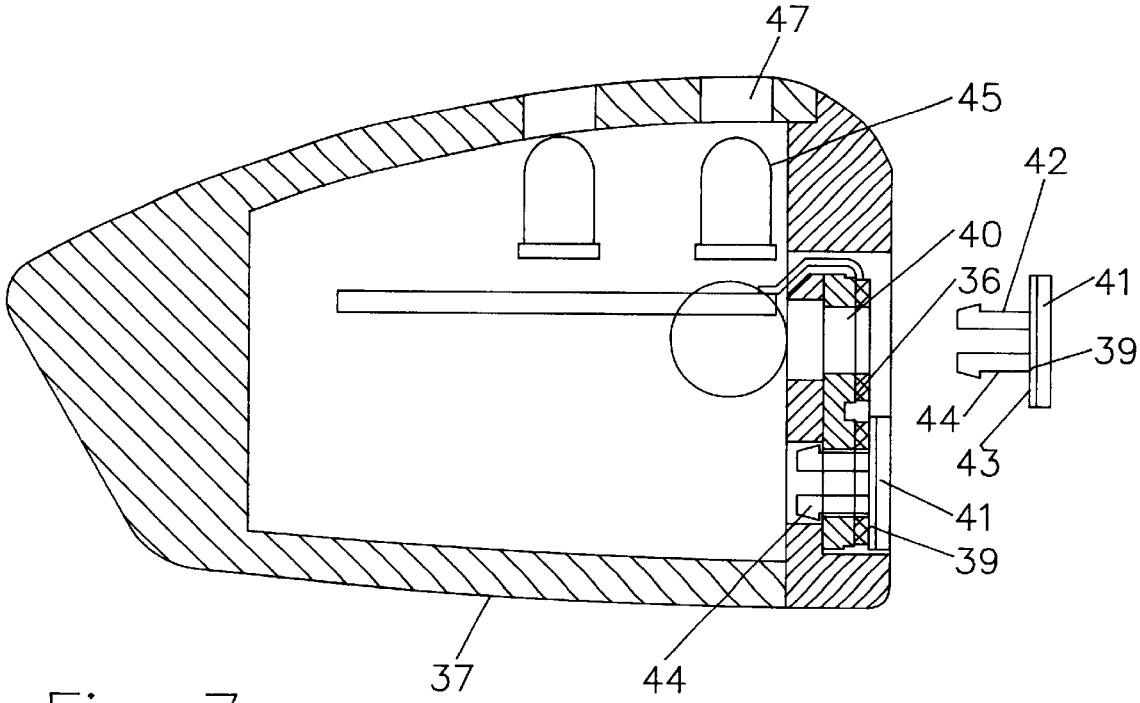
FIG. 7 is a sectional view of the teaching iron and wood club head taken along line 7—7 of FIG. 6A showing one elastomer coated plate adjacent to and touching a sensor element and another elastomer coated plate with U-shaped projections not yet inserted into a sensor element aperture.

Referring to FIG. 6A, at least one sensor element 36 inserted on teaching irons and "woods" 37 club faces 38 and at least one plate 39 disposed to cover the sensor element 36 are illustrated. The sensor element 36 is preferably a piezoelectric film sensor. Each sensor element 36 defines a centrally located preferably square shaped, stepped down aperture 40. In FIG. 7, a sectional view taken through line 7—7 of FIG. 6A, plate 39 has a front elastomer or thin hard material covered front surface 41 and centrally located flexible U-shaped projections 42 perpendicularly affixed to a back surface 43. The U-shaped projections 42 have leg portions 44 with outwardly bend distal ends to provide securing means for plate 39 to iron and "wood" club face 38 so that insertion of plate 39 projections 42 into stepped down aperture 40 results in the plate 39 back surface 43 pressing against and covering sensor element 36 to minimized iron and "wood" 37 club head vibrations from golf ball impacts. Plate 39 can be fabricated from a metal alloy or high impact plastic material in order to withstand high impact forces but also have flexible U-shaped projections 42 leg portions 44. Each sensor element 36 is covered by a plate 39. In the sensor 36 array as illustrated in FIG. 6A, plates 39 are adjacent and touching. Touching plates 39 elastomer covered surfaces 41 result in a smooth, planar club face 38. As illustrated in FIG. 2, sensor elements 36 in the same manner as sensor elements 12 are electrically connected to a circuit board having LED 45 output signal means. LEDs 45 are observed through iron and "wood" 37 top surface 46 apertures 47 as illustrated in FIG. 6B.

Figure 8:
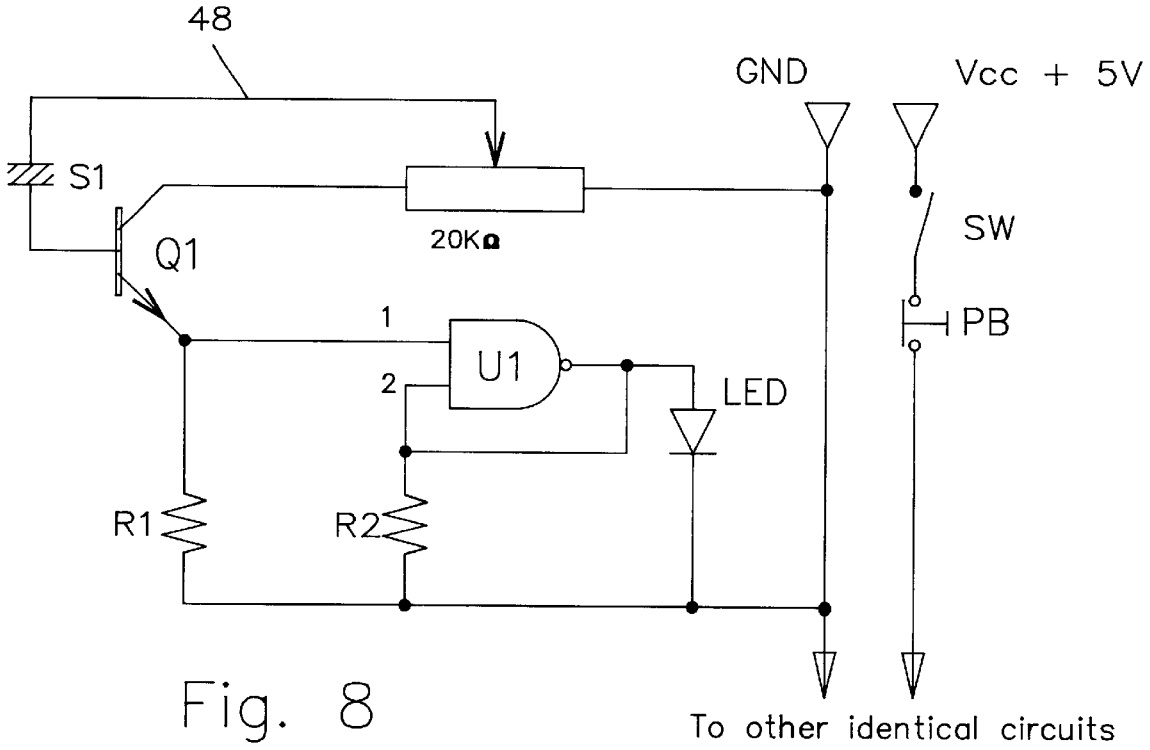
FIG. 8 is a schematic diagram of an electrical circuit for a teaching iron or teaching "wood".
Figure 9B:
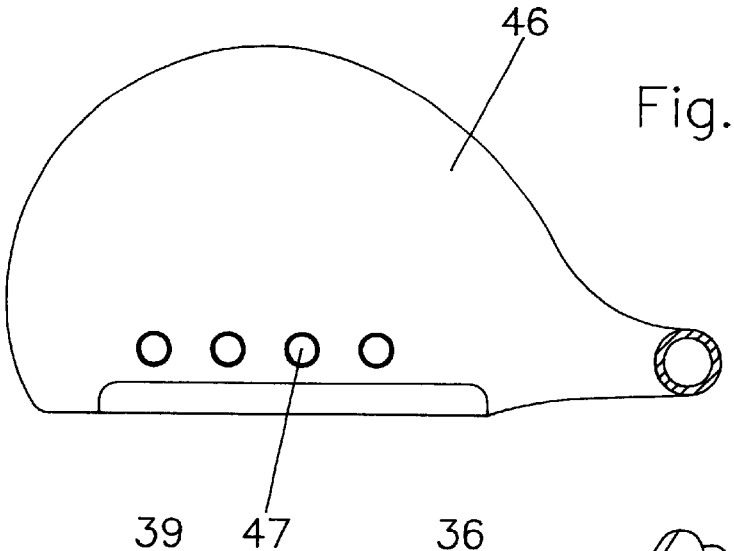
FIG. 9B is a top plan view of another embodiment of a teaching iron.
Figure 9A:
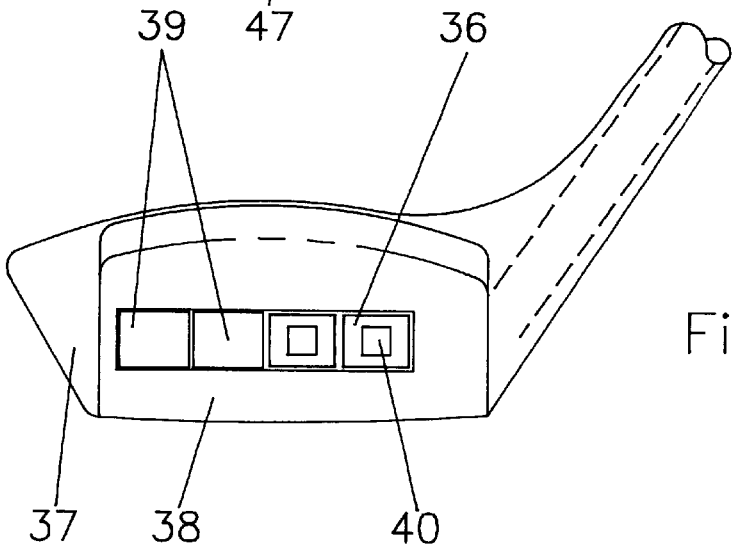
FIG. 9A is a front plan view of another embodiment of a teaching iron.

FIG. 8 is a schematic representation of LED 45 output circuitry 48 for iron and "woods" 37 having sensor element 36 arrays as shown in FIGS. 6A and 9A. Represented is one segment of a plurality of electrically connected identical circuits 48 having a common power supply 30, on off switch 32 and reset button 31. The on off switch 32 can be flush with or set into a club grip cap and the reset button 31 can be set into or flush with a club grip. See FIG. 5. Each segment as illustrated in FIG. 8 has one sensor element 36 corresponding to one LED 45 output signal. The number of sensor elements 36 and corresponding LEDs 45 are limited only by an iron or "wood" club head size.

In circuit 48 as diagramed in FIG. 8, a piezoelectric sensor element 36 labeled S1 has a 450 pF capacitance when it is not disturbed. At the time of impact, this capacitance momentarily changes to up to 40% of its nominal value. At that time, positive voltage passes through a plate of S1. Additionally, due to piezo effect, a small amount of voltage is generated and added to voltage from power supply 30. This supplies enough power to turn on transistor Q1 and, therefore to make pin No. 2 of chip U1 HI and turn on LED 45. Once an initial signal from a golf ball impact distortion of S1 disappears, the HI state is maintained through pin No. 2 feedback. Therefore, LED 45 remains on as long as reset button 31 is not pressed.

In FIG. 9A, an array of four sensor elements 36 in a single horizontal row showing two sensor elements 36 covered by two plates 39 illustrate another arrangement for iron and "wood" ball impact information. Apertures 47, as shown in FIG. 9B, provide means for observing LEDs 45. Plates 39 have elastomer or thin hard material front surface covers 41 and back surface 43 projections 42 which are received by sensor elements 36 centrally placed apertures 40. The plates 39 are illustrated in FIG. 7. As in FIG. 7, plates 39 back surfaces 43 are pressing against and covering sensor elements 36. Plates 39 are adjacent and touching to form a smooth, planar iron and "wood" 37 club face 38. All other aspects of the iron and "wood" 37 as illustrated in FIGS. 9A and 9B are the same as those described above for the FIGS. 6A and 6B iron and "wood" 37 teaching clubs.

Returning to FIG. 2, teaching putters printed circuit 26 as illustrated in FIG. 3 and irons and "woods" printed circuit 48 are each separately embedded on circuit boards 27 and inserted into respective club head cavities, the circuit boards 27 secured tightly by friction force, screw means or in any manner that will firmly hold the circuit boards 27 in place. In another embodiment, iron and "wood" printed circuit 48 separately embedded on circuit boards 27 can be inserted in a molded plastic matrix forming part of a iron and "wood" club head.

Figure 10:
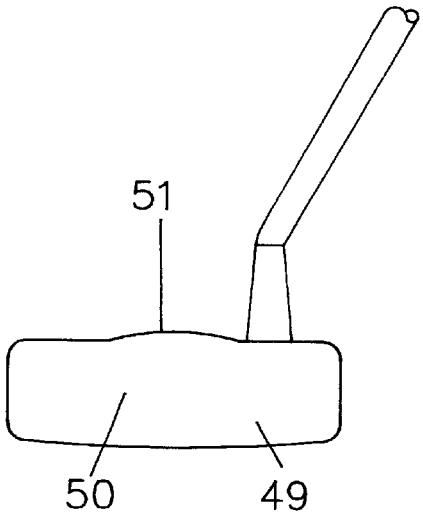
FIG. 10 is a front plan view of a PGA approved putter matching the teaching putter of the present invention.

Referring to FIG. 10, a PGA approved putter 49 is illustrated having an elastomer or thin hard material face cover 50 affixed to a solid, flat, planar face plate and having a presently known conventional top wall 51, side wall and club head construction. Putter 49 can be substantially identical to the putter 10 as illustrated in FIG. 1A and the club shaft as illustrated in FIG. 5 in weight, balance, size, shape, construction materials and general appearance.

Figure 11:
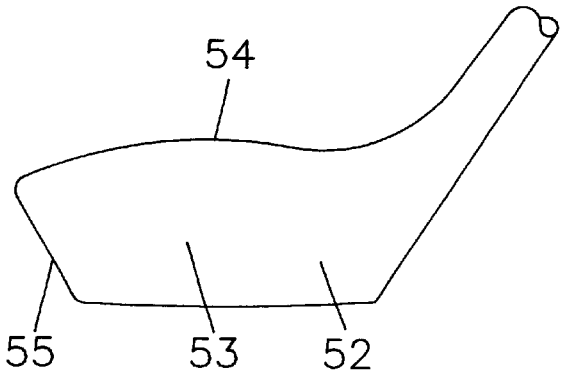
FIG. 11 is a front plan view of a PGA approved iron and "wood" matching the teaching iron and "wood" of the present invention.

FIG. 11 illustrates a PGA approved iron and "wood" 52 having a solid, flat, planar face 53, a spheroidal top wall 54, spheroidal side walls 55 and a sole plate of conventional iron and "wood" club head construction. The iron and "wood" 52 can be substantially identical to the teaching irons as illustrated in FIGS. 6A, 6B, 9A and 9B, and the club shaft as illustrated in FIG. 5 in weight, balance, size, shape, construction materials and general appearance.

Even though the present invention has been described with respect to preferred embodiments, one of ordinary skill in the art can make many changes and modifications in form and detail in the golf clubs of the present invention to adapt them to certain conditions and usages without departing from the scope and spirit of the invention. In this regard, by way of example, sensors other than piezoelectric sensors may be used, for example, variable capacitor and variable resistance sensor as shown in U.S. Pat. Nos. 4,388,668 and 5,349,867. In addition, instead of being in a "separate" cavity, the electronics may be encapsulated and embedded in a high strength plastic matrix forming a part of the club head. Accordingly, the present invention is not limited to the embodiments more specifically described herein; and all such changes and modifications are properly intended to be within the full range of equivalents of the following claims.

What is claimed is:

1. A teaching putter golf club comprising a club head having a club face and a club top surface;

more than one piezoelectric sensor element embedded in said club face surface so that a flat, planar club face surface results said sensor elements parallel to said club face and arranged so that at least one sensor element covers a club face preferred impact center;

an elastomer cover having a smooth outer surface designed to make contact with a golf ball and a grooved inner surface, said grooves defining shapes large enough to cover underlying piezoelectric sensor elements, said elastomer cover designed to cover and protect said club face surface;

an electrical circuit printed on a circuit board placed within said club head;

said printed circuit enabled with means for detecting a golf ball impact location on said club face;

said electrical circuit having light emitting diode (LED) visual output means, each piezoelectric sensor element similarly wired to an individual LED so that a golf ball impact on a single piezoelectric sensor results in a single corresponding LED colored output signal and a golf ball simultaneously impacting on more than one piezoelectric sensor results in more than one simultaneous corresponding LED output signal; said piezoelectric sensor element wired to said LED comprising a voltage regulator controlling an electrical circuit transistor to transistor voltage, an operational amplifier connected in a differential mode open loop for high sensitivity, resistors limiting current input from said sensor element and from a power supply, resistors and a voltage divider that adjust inverting voltage input when said sensor element is undisturbed so that said operating amplifier voltage is high enough to maintain a chip logical HI of a first NAND gate and a set/reset latch, with a reset pin that is HI so that said latch output is LOW and said LED is turned off until said operating amplifier provides an output in a range of logical LOW that results in an output of said set/reset latch to turn HI which, limited by a resistor, turns on a transistor and said LED, said electrical circuit remaining latched in said HI position so that said LED remains on without said sensor element stimulation until a user presses a reset button and said latch is reset, more that one aperture in said club top surface; said LEDs received by said apertures; said number of apertures equaling said number of LEDs and said number of piezoelectric sensor elements, said apertures arranged in a pattern the same as said piezoelectric sensor elements' pattern;

a resilient elastomer material having a grid pattered surface for said sensor element adhesion forming a sensor grid assembly with said piezoelectric sensor elements and said elastomer cover;

a resilient, foam like material placed behind said sensor grid assembly which minimizes vibrations and intensifies an electrical signal generated by said club face impacting a golf ball; and a shaft having a distal end grip portion having a grip cap top with on off switch means and a grip cap side with reset switch means.

2. The teaching putter golf club of claim 1 wherein there are two horizontal rows of three sensor elements positioned so that center sensor elements overlie said golf club preferred impact center and apertures in said club head top surface correspond in position to said two horizontal rows of three sensor elements, said apertures containing LEDs that provide more than one color visual output information indicating a golf ball impact position on said putter face.

3. The teaching putter golf club of claim 1 wherein there is one horizontal row of six sensor elements positioned so that center sensor elements overlie said golf club preferred impact center and apertures in said club head top surface correspond in position to said one horizontal row of six sensor elements, said apertures containing LEDs that provide more than one color visual output information indicating a golf ball impact position on said putter face.

4. The teaching putter golf club of claim 1 wherein said cover is a thin hard material.

5. The teaching putter golf club of claim 1 wherein said electrical circuit printed on said circuit board is inserted in a molded plastic matrix forming part of said club head.

6. The teaching putter golf club of claim 1 wherein said teaching putter golf club has a weight, flexibility; balance, size, shape, construction materials and general appearance that is duplicated in a Professional Golf Association (PGA) approved putter golf club for golfer use after said golfer attains a correct golf swing that becomes part of said golfer's muscle memory as a result of practice with said teaching putter golf club.

7. The Professional Golf Association (PGA) approved putter golf club of claims 6 having an elastomer face cover affixed to a solid, flat, planar face plate and having a presently known conventional top wall, side wall and club head construction.

8. The Professional Golf Association (PGA) approved putter golf club of claim 7 having a thin, hard material face cover.

9. A teaching iron golf club and "wood" golf club each one comprising a club head having a club face and a club top surface;

more than one piezoelectric sensor element embedded in said club face so that a flat, planar club face surface results, said each piezoelectric sensor element defining a centrally located stepped down aperture;

more than one elastomer covered plate, each plate having a back surface with centrally located U-shaped flexible projections extending perpendicular to said plate back surface, said flexible projections received by said stepped down apertures so that said plate is snapped against said piezoelectric sensor element;

an electrical circuit printed on a circuit board within said club head; said electrical circuit comprising said piezoelectric sensor element which has a 450 pF capacitance when not disturbed and changes up to 40% of its nominal value when said elastomer cover plate is impacted by golf ball contact allowing positive voltage to pass through said elastomer cover plate to said piezoelectric sensor where a small amount of additional voltage is added to a power supply voltage in order to turn on a transistor and then make a pin of an electronic chip HI in order to turn on an LED corresponding to said piezoelectric sensor element, said HI state maintained through another pin feedback until a rest button is pressed by a user;

more that one aperture in said club top surface; more than one LED received by said apertures; said number of apertures equaling said number of LEDs and said number of piezoelectric sensor elements, said apertures arranged in a pattern the same as said piezoelectric sensor elements' pattern; and a shaft having a distal end grip portion having a grip cap top with on off switch means and a grip cap side with reset switch means.

10. The teaching iron golf club and "wood" golf club of claim 9 wherein there are two parallel horizontal rows of three sensor elements positioned so that center sensor elements overlie said golf club preferred impact center and apertures in said club head top surface correspond in position to said two parallel rows of three sensor elements, said apertures containing LEDs that provide visual output information indicating a golf ball impact position on said putter face.

11. The teaching iron golf club and "wood" golf club of claim 9 wherein there is one horizontal row of four sensor elements positioned so that center sensors overlie said golf club preferred impact center and apertures in said club head top surface corresponding in position to said one horizontal row of four sensor elements' said apertures containing LEDs that provide visual output information indicating a golf ball impact position on said putter face.

12. The teaching iron golf club and "wood" golf club of claim 9 wherein said U-shaped flexible projections have leg portions with outwardly bent distal ends for secure placement into said stepped down apertures.

13. The teaching iron golf club and "wood" golf club of claim 9 wherein said electrical circuit printed on said circuit board is inserted and held by friction force in a club head cavity.

14. The teaching iron golf club and "wood" golf club of claim 9 wherein said electrical circuit printed on said circuit board is inserted in a molded plastic matrix forming part of said club head.

15. The teaching iron golf club and "wood" golf club of claim 9 wherein said teaching iron golf club and "wood" golf club have a weight, flexibility; balance, size, shape, construction materials and general appearance that is duplicated in a Professional Golf Association (PGA) approved iron golf club and a PGA approved "wood" golf club for a golfer's use after said golfer attains a correct golf swing that becomes part of said golfer's muscle memory as a result of practice with said teaching iron golf club and "wood" golf club.

16. The Professional Golf Association (PGA) approved iron golf club and PGA approved "wood" golf club of claim 15 reach having a solid, flat, planar face, a spheroidal top wall, spheroidal side walls and a sole plate of conventional iron and "wood" golf club construction.

* * * * *